United States Patent [19]

Tatoian

[11] Patent Number: 4,750,508

[45] Date of Patent: Jun. 14, 1988

[54] COLLAPSIBLE BEACH SUNSHADE

[76] Inventor: James Z. Tatoian, 1957 Garfias Dr., Pasadena, Calif. 91104

[21] Appl. No.: 894,263

[22] Filed: Aug. 6, 1986

[51] Int. Cl.[4] ..... E04H 15/00; E04H 15/62

[52] U.S. Cl. ..... 135/87; 135/118

[58] Field of Search ..... 135/118, 87

[56] References Cited

U.S. PATENT DOCUMENTS

| | | | |
|---|---|---|---|
| 2,777,454 | 1/1957 | Kramer . | |
| 2,886,047 | 5/1959 | Healy . | |
| 2,888,021 | 5/1959 | Adams . | |
| 2,928,405 | 3/1960 | Lawson . | |
| 2,938,524 | 5/1960 | Benson | 135/118 |
| 3,195,898 | 7/1965 | Respini | 135/118 X |
| 3,394,720 | 7/1968 | Moss | 135/118 X |
| 3,581,436 | 6/1971 | Basiger . | |
| 3,732,878 | 5/1973 | Blankemeyer et al. | 135/118 |
| 3,788,336 | 1/1974 | Steffes | 135/118 |
| 4,086,931 | 5/1978 | Hall | 135/118 X |
| 4,185,424 | 1/1980 | Streit | 135/118 X |
| 4,367,761 | 1/1983 | Winant . | |
| 4,404,980 | 9/1983 | Wade | 135/118 X |
| 4,487,212 | 12/1984 | Moore . | |

FOREIGN PATENT DOCUMENTS

| | | | |
|---|---|---|---|
| 630782 | 11/1961 | Canada | 135/118 |

*Primary Examiner*—J. Karl Bell

*Attorney, Agent, or Firm*—Sheldon & Mak

[57] ABSTRACT

A collapsible sunshade for erecting on a sandy beach includes a polygonal sail member and a complement of supporting poles corresponding to the corners of the sail member, the poles being particularly flexible for maintaining a desired tension in the sail member without requiring accurate positioning of the poles in the sand. The poles each have a triangular trough-shaped blade member for securely anchoring in wet or dry sand with a low level of downwardly directed force being required for penetration of the poles into the sand. Loops extending from the corners of the sail member enclose respective shanks of the poles, tensioning of the loops providing frictional engagement with the shank members for supporting the vertical load of the sail member. The loops of the sail member can be adjusted up and down individually on the poles, the flexibility of the shank members assuring the required frictional engagement, even when the sunshade is exposed to winds and accidental contact. One or more sideshade members can be selectively positioned along the edges of the sail members for additional shading when the sun is low in the sky.

36 Claims, 2 Drawing Sheets

COLLAPSIBLE BEACH SUNSHADE

BACKGROUND

The present invention relates to portable shelters, and more particularly to a collapsible shelter for use on plots of loose earth such as a sandy beach and the like.

Varieties of portable structures are known in the prior art. One type has a plurality of legs and a flexible cover member that is suspended by the legs. See, for example, U.S. Pat. No. 2,777,450 to Kramer.

A disadvantage of these structures is that the legs are hard to drive into sand sufficiently deep for properly supporting the cover, particularly when the wind is blowing. This is true whether the sand is loose and dry, requiring the legs to be driven in very deep, and when the sand is wet, requiring large driving forces for even shallow penetration of the legs into the sand.

Another disadvantage is that the legs are attached in a fixed relation to the cover, so that one cannot adjust the sag of the cover when the legs are affixed rigidly in the ground. The legs, being metal tubing, do not provide flexibility for maintaining a desired tension of the cover. Also, it is difficult to align four legs with four fixed attachment points on the cover for providing a uniformly flat smooth surface of the cover.

Another disadvantage is that vertical adjustment of the cover requires telescoping the legs. This complicates the leg construction, adding unnecessary costs to the umbrella.

A further disadvantage is that the legs must be repositioned for producing a sideshade configuration.

Thus there is a need for a portable beach sunshade that is easy to erect firmly anchored on wet or dry sand, that maintains firm and even tension on the cover, and provides a sideshade capability on any selected side without requiring leg repositioning or a reduction in overhead coverage, and permits convenient vertical adjustment without the complexity and expense of telescopic legs.

SUMMARY

The present invention meets this need by providing a beach sunshade that includes a polygonal sheet member and a plurality of flexible poles corresponding to the corners of the sheet member, each pole having a shank member and a blade member for driving into sand, means for connecting the sheet member to the poles, and means for biasing the poles outwardly against the connecting means for supporting the sheet member by frictional contact with the shanks of respective poles in response to tension in the sheet member. Thus tension in the sheet member is advantageously maintained over a range of pole positions in the sand outside the vertically projected area of the sheet member.

Preferably each blade member has a plate member extending on opposite sides downwardly from the shank member and parallel to it, and an upper flange surface perpendicular to the plate member for receiving a force driving the pole downwardly into the sand. Thus one holding the pole can easily drive the blade member into the sand with his foot, whether or not he is wearing shoes. More preferably, the plate member is triangular with a lower apex substantially in line with the shank member. Also, the length of the plate member from the flange surface to the lower apex is preferably from about 1.5 to 2.5 times the width of the plate member. Thus the plate member enters the sand easily, yet provides a high degree of rigidity for supporting the shank member. Further, the blade member preferably includes a portion having a trough-shaped cross section, opposite sides forming a dihedral angle from about 80° to about 160° and more preferably, from about 90° to about 115° for providing lateral stability, and for reducing the displacement of sand around the sides of the plate member when the pole is loaded by tension on the sheet member.

Preferably the blade member is detachable from the shank member for compact storage of the poles. The blade member can have a socket member for lengthwise insertion of the shank member. Also, the shank member can have detachable upper and lower portions for even more compact storage.

Preferably the shank member is tubular for reducing the material volume and stress level in the poles. The shank member can be made from a plastic material, preferably styrene, ABS, polypropylene, polyethylene, or polyvinyl chloride, the polyvinyl chloride being more preferable. Most preferably, the shank member is formed from a mixture of about 90% polyvinyl chloride, about all of the remainder being glass particles for enhanced strength and rigidity and/or reduced material volume.

Preferably the baising means includes flexibility of the shank members, and exhibits a horizontal lateral deflection from about 4 to about 10 inches under a horizontal load of 4 pounds applied 4 feet vertically above ground level.

The sunshade can have a sideshade member extending downwardly from an edge of the sheet member when lateral shading is desired, for example, when the sun is close to the horizon. Preferably, the sideshade member is attached to the sheet member by means providing selective positioning of the sideshade member at a selected edge of the sheet member. The attaching means can include a velcro fastener connecting the sideshade member and the sheet member.

The connecting means can be a cord member affixed at each corner of the sheet member, each cord member forming a loop for receiving the respective shank member. Preferably at least some of the loops at the corners of the sheet member are adjustable for adjusting the tension of the sheet member after the poles have been driven into the sand, providing further flexibility in the positioning of the poles and faciliting erection of the sunshade.

The present invention also provides a method for shading a plot of sand including the steps of:

(a) providing a polygonal sheet member having at least three corners;

(b) providing a plurality of anchor poles corresponding to the corners of the sheet member, each pole comprising:

(i) a blade member for driving into the sand, each blade member comprising a triangular plate member extending on opposite sides of the shank member and downwardly in parallel relation to the shank member, the plate member having a lower apex substantially in line with the shank member and a substantially horizontal upper surface, the blade member having a trough-shaped cross-section along an axis paralleling the shank member;

(ii) a flexible cylindrically tubular shank member extending upwardly from the blade member, the shank member comprising a plastic material selected from a group consisting of styrene, ABS, polypropylene, PVC, and polyethylene, the shank member exhibiting a lateral deflection of between about 4 inches to about 10 inches horizontally under a horizontal load of 4 pounds force applied 4 feet vertically above a rigidly fixed lower end of the shank member;

(c) providing means for connecting each corner of the sheet member to the shank member of the respective pole;

(d) driving the anchor poles into the sand in a pattern corresponding to the corners of the sheet member and displaced outwardly therefrom beyond the connecting means;

(e) deflecting the shank members inwardly toward the sheet member;

(f) engaging the connecting means with the shank members;

(g) tensioning the sheet member by the connecting means so that sheet member is supported by frictional contact between the connecting means and the shank members at a desired location along each of the shank members.

The present invention advantageously allows the sheet member to be adjusted upwards and downwards on the poles without a need to manipulate screws, bolts, or special locking or fixing devices to keep the sheet in a desired position. Also, the poles do not need the added complexity of telescoping for changing the height of the sheet member.

DRAWINGS

These and other features, aspects, and advantages of the present invention will become better understood with reference to the following description, appended claims, and accompanying drawings where:

DESCRIPTION

Figure 1:
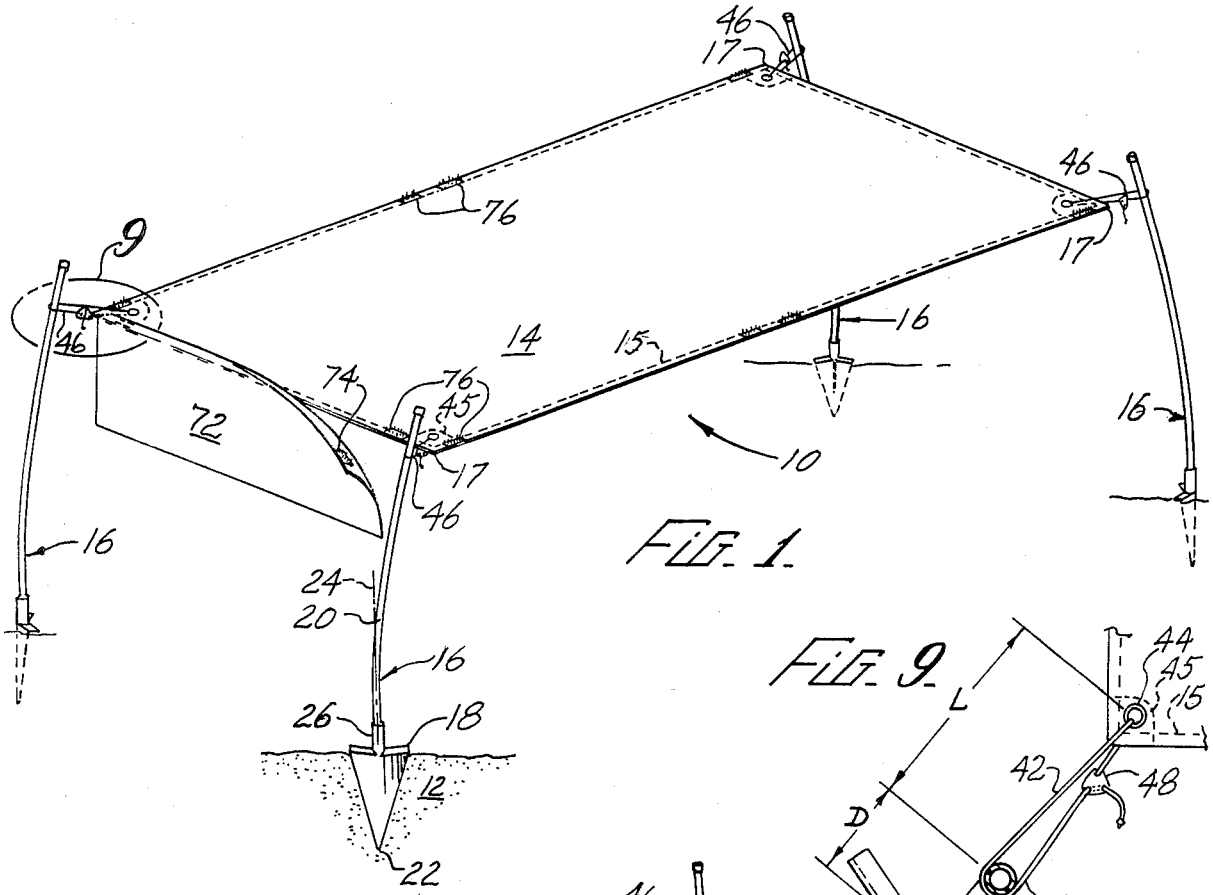
FIG. 1 is an oblique elevational perspective view of apparatus according to the present invention.

The present invention is directed to a portable sunshade for use on a sandy plot such as a beach. With reference to the drawings, a sunshade 10 is set up on a plot of sand 12, the sunshade 10 having a polygonal sheet member or sail 14 supported by a plurality of poles 16, the number of the poles 16 corresponding to the number of corners 17 of the sail 14. The sail 14 is reinforced at its edges by a hem 15. In one version, shown in FIG. 1, the sail 14 is rectangular, having four of the corners 17, there being four of the poles 16.

The poles 16 each include a blade member 18 for driving into the sand 12, and an elongated shank member 20. As shown in FIGS. 4–8, the blade member 18 has a large surface area for rigidly anchoring the pole 16 in the sand 12 and resisting a lateral load tensioning the sail 14. The blade member is also triangular in elevation, extending downwardly to a bottom apex 22 approximately in line with a root axis 24 of the shank member 20 for facilitating penetration of the sand 12. A cylindrical socket member 26 extends upwardly from the blade member 18 for lengthwise receiving the bottom of the shank member 20.

The blade member 18 is preferably trough-shaped in cross-section for enhanced stability in loose sand. As further described herein, a concave or "front" side of the blade member 18 is intended to face toward the sheet member when the sunshade 10 is erected. This configuration imparts structural rigidity to the blade member 18 and resists migration of sand around the sides of the blade member when the pole 16 is laterally loaded by tension on the sail 14.

The blade member 18 extends laterally on opposite sides of the root axis 24 and forms a pair of plane side portions 28 and 30. The side portions 28 and 30 are each tangent to a cylindrical segment member 32, the segment member 32 forming a downward extension of the socket member 26 on a rear side of the root axis 24. Thus the side portions 28 and 30 from a dihedral angle A less than 180° facing forward toward the root axis 24 along a line parallel thereto and located proximate the outside of the segment member 32. The bottom apex 22 is thus located on the segment member 32, displaced half the diameter of the socket member 26 from the root axis 24.

Figure 6:
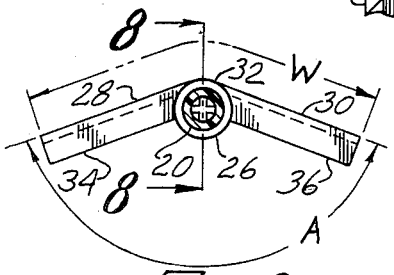
FIG. 6 is a plan sectional view of the apparatus of FIG. 1 on line 6—6 in FIG. 4.
Figure 7:
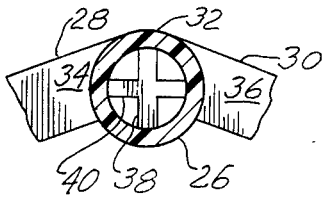
FIG. 7 is a fragmentary sectional plan view of the apparatus of FIG. 1 on line 7—7 in FIG. 4.

A pair of flange members, designated 34 and 36 in the drawings, are formed at the top of the blade member 18, the flange members 34 and 36 extending forwardly, perpendicular to the respective side portions 28 and 30. The tops of the flange members 34 and 36 are approximately horizontal, sloping slightly downwardly away from the socket member 32 for providing a convenient and comfortable footrest surface for driving the blade member 18 into the sand. The flange members 34 and 36 are rigidly joined to the socket member 32 for stiffening and strengthening the blade member 18. As shown in FIG. 6, the blade member has a "flat-pattern" width W measured along the side portions 28 and 30 between the opposite ends of the flange members 34 and 36, and including the segment member 26.

A gusset member 38, extending across the interior of the socket member 32 from slightly above the bottom thereof, extends downwardly along the segment member 32 for stiffening and strengthening the attachment of the socket member 32 to the blade member 18. Further strengthening is provided by a cross-member 40 intersecting the gusset member 38 within the socket member 32, the gusset member 38 and the cross-member 40 vertically locating the bottom of the shank member 20.

The blade member 18 is preferably a molded plastic part for ease of manufacture. Materials appropriate for the blade member 18 include polymers such as styrene, nylon, polypropylene, polyvinyl chloride (PvC), and polyethylene. Also appropriate are copolymers such as acrylonitrilebutadine-styrene (ABS). Of these materials, it is expected that polypropylene provides a most advantageous combination of high strength, low cost, wear resistance, chemical inactivity, and moldability for forming the blade member 18.

The blade member 18 is particulary effective for anchoring the poles 16 in the sand 12. This has been demonstrated in both dry sand and wet sand in tests comparing the vertical force required to drive a given stake 7 inches down into the sand, and the lateral force capability of the pole when the force is applied horizontally at the top of the pole, four feet above ground level. The following pole configurations were tested:

1. Blunt—cylindrical ¾ inch diameter, flat bottom;
2. Pointed—cylindrical, ¾ inch diameter, conical end;
3. Rectangular—flat blade, 6.25 inches wide, 7 inches high;
4. Triangular—flat inverted delta, 6.25 inches wide, 7 inches high;
5. Trough—inverted delta, 6.25 inches wide in flat pattern, 7 inches high, a central vertical portion forming a cylindrical extension of the pole from which opposite sides extend at a dihedral angle of 105°.

The results of the tests are given in Table 1, each value in the table representing a root mean square average of three measurements, in pounds. Herein, the term root mean square average is the square root of the reciprocal of the number of measurements times the sum of the squares of the individual measurements.

TABLE 1

Vertical Insertion Force and Lateral Load Capacity Comparison

| Pole Configuration | Dry Sand Vertical | Dry Sand Lateral | Wet Sand Vertical | Wet Sand Lateral |
|---|---|---|---|---|
| 1. Blunt | 70 | 2.3 | 78 | 3.4 |
| 2. Pointed | 61 | 2.8 | 66 | 3.8 |
| 3. Rectangular | 42 | 14.9 | 47 | 18.7 |
| 4. Triangular | 27 | 13.8 | 30 | 16.9 |
| 5. Trough | 24 | 18.0 | 29 | 24.0 |

As shown in Table 1, the trough configuration 5 provides more than six times the lateral load capacity of the pointed configuration 2 whether the sand is wet or dry. Contrarily, the pointed configuration 2 requires more than two times the vertical force that is required to drive the trough configuration 5 down into the sand. More importantly, the trough configuration rquires less insertion force and has greater lateral load capacity than either the rectangular or triangular configurations.

In the present invention, a more preferred configuration of the blade member 18 is longer, having a length of approximately 12 inches from the bottom apex 22 to the junction of the flange members 34 and 36 with the socket member 26, the width W being about 6.25 inches as in the trough configuration 5 described above. It should be understood that larger and smaller versions of the blade member 18 are possible, it being generally preferred that the length and width be proportioned relatively as described above. In particular, it is preferred that the length of the blade member between the flange members 34 and 36 to the bottom apex 22 be from about 1.5 to about 2.5 times the width, most preferably about 2 times the width W.

Further tests were performed for determining a preferred range of the dihedral angle A. The angle A was varied in increments of 20° from 40° to 180° in dry sand, the vertical and horizontal forces being determined as described above. The results of the test are given in Table 2, each value in the table representing a root mean square average of 5 measurements, in pounds.

TABLE 2

Vertical Insertion Force and Lateral Load Capacity of Trough Configuration as a Function of Dihedral Angle A

| Dihedral Angle A | Dry Sand Vertical | Dry Sand Lateral |
|---|---|---|
| 180° | 27.0 | 13.8 |
| 160° | 26.6 | 15.2 |
| 140° | 26.6 | 16.5 |
| 120° | 25.1 | 17.8 |
| 100° | 24.0 | 18.2 |
| 80° | 23.5 | 15.4 |
| 60° | 23.3 | 11.9 |
| 40° | 23.0 | 8.1 |

As shown in Table 2, the greatest lateral load capacity of the trough configuration was attained at a dihedral angle A of 100°. The lateral load capacity falls off rapidly as the angle A is reduced below about 90°, falling less rapidly as the angle A is decreased above 120°. Also, the vertical insertion force is greatest when the angle A is 180° (corresponding to the triangular configuration for, above), and is reduced by about 15% when the angle A is only 40°. The insertion force falls off most rapidly as the angle A is reduced from about 140° to about 100°. Based on these results, it is preferred that the dihedral angle A be between about a 80° and about 160°. When the angle A is less than about 80°, the blade member 18 presents a significantly reduced laterally projected area to the sand 22 for resisting lateral loading by the sail 14. On the other hand, when the angle A is more than about 160°, there is a significantly increased tendency for the sand to migrate around opposite edges of the blade member 18, and both the strength and rigidity of the blade member 18 is diminished. Also, the insertion force decreases as the angle A is reduced as described above. More preferably, the angle A is between about 90° and about 115°, most preferably 100°.

Each corner 17 of the sail 14 is connected to the corresponding poles 16 by a cord 42, the cord 42, passing through a grommet 44 in the sail 14 proximate the corner 17 within a reinforcing member 45. The cord 42 forms a loop 46 through which the shank member 20 of the pole 16 is inserted, the shank member 20 engaging the loop 46 at a distance L from the grommet 44. A triangular slide member 48 closes the loop 46 and permits adjustment of the sides of the loop 46 as further described herein. One end of the cord 42 is fastened rigidly to the slide member 48; the other end of the cord 42 resistably slidably engages the slide member 48 such that tension on the loop 46 increases the resistance to sliding. Thus, by sliding the cord 42 through the slide member 48, the distance L can be decreased for adjustably tightening the sail 14 between the poles 16. Any conventional line tightener or adjuster can play the role of the slide member 48.

An important feature of the present invention is that tension in the sail 14 produces a corresponding tension in the loops 46, biasingly pressing the loops 46 against the shank members 20 and frictionally transmitting a vertical component of load corresponding to the weight of the sail 14 into the poles 16. Thus the loops 46 can be moved by hand up and down along the shank members 20 for adjusting the height of the sail 14, the loops 46 remaining where they are positioned as long as there is tension in the sail 14. Accordingly, the sail 14 can be stretched in a tilted or horizontal fashion at a desired height substantially anywhere along the shank members 20.

Figure 9:
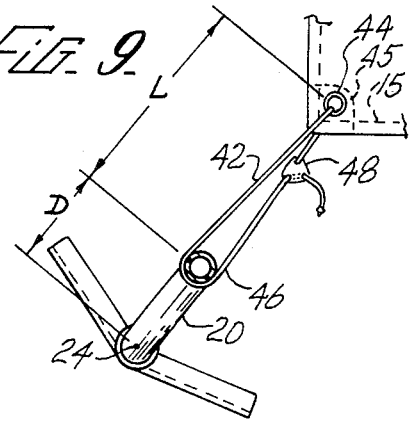
FIG. 9 is a fragmentary detail plan view of the apparatus of FIG. 1 within region 9 of FIG. 1.

Another important feature of the present invention is that the shank members 20 of the poles 16 are made flexible for maintaining tension of the sail 14, the poles 16 imparting a "spring-like" action to the sail 14. As shown in FIG. 9, the shank member 20 is deflected a horizontal distance D from the vertically oriented root axis 24 at the point of engagement with the loop 46. Thus if one of the shank members 14 is accidentally bumped into, the necessary tension on the loops 46 is sustained due to the spring deflection of the other poles 16.

Further, the flexibility of the shank members 20 permits the poles 16 to be located with great positional latitude in the sand 12. It is only necessary to locate the root axis 24 away from directly below the grommet 44 by a total distance of L+D ranging from that for the smallest size of the loop 46 and minimal tension of the sail 14 along adjacent portions of the sheet member 14, up to the largest size of the loop 46 and maximum tension of the sail 14. Also, if the sail 14 happens to stretch while in use, the shank members 20 move apart, maintaining the supporting frictional contact with the loops 46 and sustaining the tensioning of the sail 14.

The desired flexibility of the poles 16 is provided in the present invention by forming the shank members 20 from a plastic material having a light-weight tubular configuration. The use of plastic in the shank members 20 advantageously avoids the excessive heating that would otherwise be produced in metallic elements that are exposed to the sun. Suitable materials for the shank members 20 include polymers such as styrene, polypropylene, polyethylene, and PVC, and copolymers such as ABS. A particularly advantageous combination of high-strength, low cost, flexibility and commercial availability is PVC. This material is readily available in the form of plastic pipe or tubing that is especially suited for use in the present invention.

Four different configurations of the PVC tube for the shank member 20 were tested and compared with wood, aluminum, and steel members. The tested materials were as follows:

1. Wood—¾ inch diameter pine dowel;
2. Aluminum—¾ inch diameter, ⅛ inch wall thickness;
3. Steel—½ inch diameter conduit, 1/32 inch wall thickness;
4. PVC 0.5/40—½ inch diameter schedule 40 (0.840 O.D., 0.622 I.D.);
5. PVC 0.75/40—½ inch diameter schedule 40 (1.050 O.D., 0.824 I.D.);
6. PVC 0.5/80—½ inch diameter schedule 40 (0.840 O.D., 0.546 I.D.); and
7. PVC, 0.75/80—½ inch diameter schedule 40 (1.050 O.D., 0.742 I.D.)

Table 3 shows the lateral deflection in inches of one end of a four-foot length of each of the above materials, for various applied lateral forces between one pound and four pounds, the opposite end of the member being clamped in a fixed position.

TABLE 3

| Lateral Shank Deflection Comparison | | | | | |
|---|---|---|---|---|---|
| Shank | Lateral Force (lb.) | | | | |
| Configuration | 1.0 | 1.5 | 2.0 | 2.5 | 4.0 |
| 1. Wood | 0.6 | 0.9 | 1.2 | 1.6 | 2.4 |
| 2. Aluminum | 0.1 | 0.15 | 0.2 | 0.25 | 0.4 |
| 3. Steel | 0.2 | 0.3 | 0.4 | 0.5 | 0.8 |

TABLE 3-continued

| Lateral Shank Deflection Comparison | | | | | |
|---|---|---|---|---|---|
| Shank | Lateral Force (lb.) | | | | |
| Configuration | 1.0 | 1.5 | 2.0 | 2.5 | 4.0 |
| 4. .5/40 PVC | 4.1 | 6.2 | 8.2 | 10.3 | 17.0 |
| 5. .75/40 PVC | 2.2 | 2.9 | 4.2 | 5.3 | 8.2 |
| 6. .5/40 PVC | 4..1 | 6.2 | 8.3 | 10.3 | 17.1 |
| 7. .75/80 PVC | 2.1 | 2.8 | 4.1 | 5.1 | 8.0 |

The sail 14 can be made from any lightweight fabric material suitable for producing shade. Preferred materials are 200 denier Oxford nylon and 70 denier taffeta, each available from Noah Lamport, Inc., Los Angeles, Calif. In a preferred configuration of the sail 14 having a length of 83 inches and a width of 45 inches, it has been determined that a sufficient lateral tension applied to the corners 17 is about 3.5 pounds. It has also been determined that a preferred deflection of the shank member 20 at a height about 4 feet above the sand 12 is a deflection of about 7 inches. This corresponds roughly to the results given in Table 3 for the ¾ diameter PVC tube, either schedule 40 or schedule 80. As between these two, the schedule 40 is preferred because it is lighter in weight and less expensive to produce because the volume of material is reduced. Thus it is apparent from Table 3 that the stiffness of the shank member 20 is primarily related to the diameter of the tube, and depends only slightly on the wall thickness. Thus as long as the wall thickness is great enough to provide sufficient strength, a small wall thickness is preferred. Accordingly, the ¾ inch diameter schedule 40 PVC tube is more preferred. In comparison, the corresponding deflection of the steel and aluminum is only 1/10 or 1/20 of the preferred deflection, well below what is needed for use in the present invention. The steel and aluminum also get uncomfortably hot in the sun. The wood that was tested provides less than ⅓ the preferred deflection, and is subject to weathering and breakage.

The ½ inch diameter PVC schedule 40 tube has excessive deflection, but otherwise would be preferred because it is more compact and requires less material than the ¾ inch diameter schedule 40. It is expected that the ½ inch diameter schedule 40 dimensions are most preferable for the shank member 20, and that increased stiffness comparable to the ¾ inch diameter schedule 40 tube is possible using a mixture of PVC and a reinforcing material. Exemplary reinforcing materials are carbon or glass fibers and glass particles. It is expected that a preferred composition for the shank member 20 is from about 70% to about 95% of the PVC, the remainder being the reinforcing material. It is further expected that an optimum composition is 90% PVC and 10% reinforcing material. It is further preferred that the reinforcing material be the glass particles because the glass particles are inexpensive and readily available, and have a sufficient modulus of elasticity to significantly increase the rigidity of the shank member 20.

The present invention includes a sideshade 72 formed from a flexible member as shown in FIG. 1, the sideshade 72 having first fastener means 74 located proximate an edge thereof. The sail member 14 has, along the edges thereof, second fastener means 76 for selective engagement for the first fastener means 74 of the sideshade 72. Thus one or more of the sideshades 72 can be removably fastened at selected locations around the sail member 14. As the day progresses, the sideshade 72 can be moved around on the sail member 14 in response to changes in the relative position of the sun. Thus the present invention permits the sideshade 72 to be installed and repositioned without requiring the poles 16 to be repositioned. The first fastener means 74 and the second fastener means 76 can be mating members of velcro fasteners.

Figure 2:
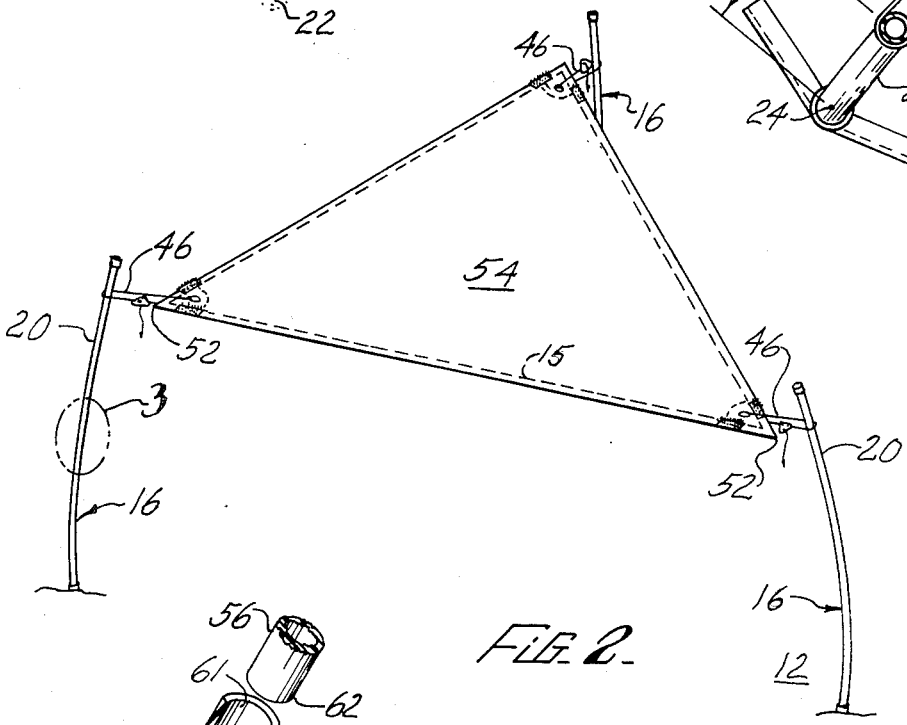
FIG. 2 is an oblique elevational perspective view of an alternative configuration of the apparatus of FIG. 1.
Figure 3:
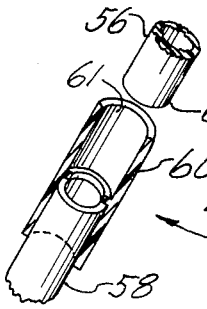
FIG. 3 is a fragmentary sectional perspective view of an alternate configuration of FIG. 2 within region 3 of FIG. 2.
Figure 4:
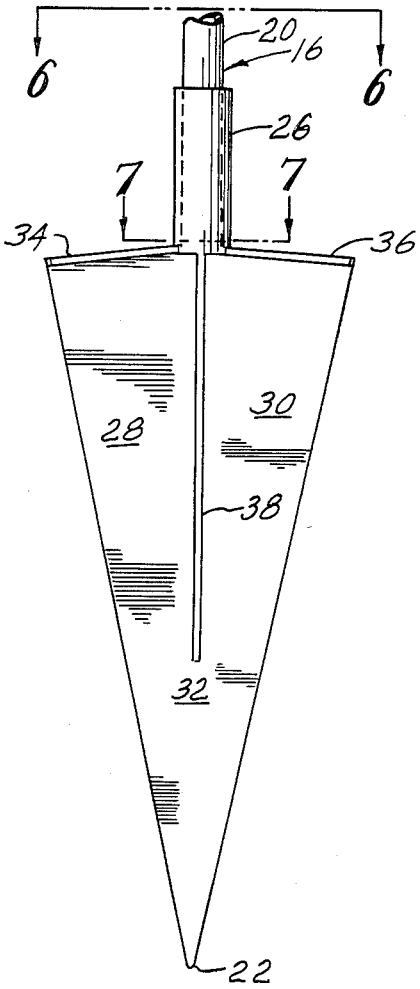
FIG. 4 is a front elevational detail view of the apparatus of FIG. 1 within region 4 of FIG. 1.
Figure 5:
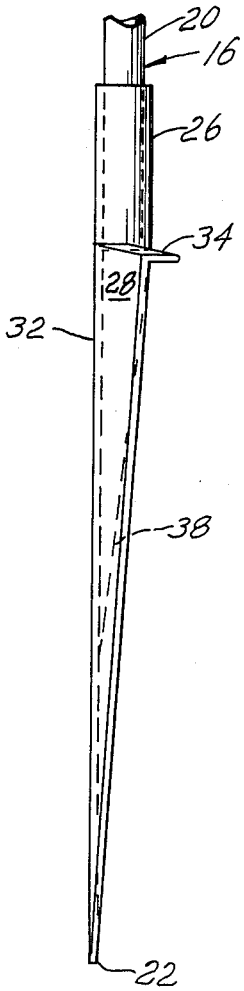
FIG. 5 is a side elevational view as in FIG. 4.
Figure 8:
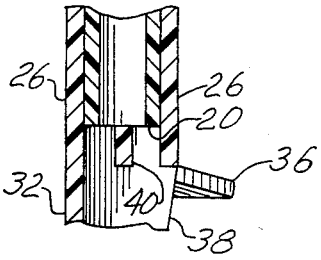
FIG. 8 is a fragmentary sectional elevational view of the apparatus of FIG. 1 on line 8—8 in FIG. 6.

With particular reference to FIGS. 2 and 3, another configuration of the sunshade 10 of the present invention has 3 of the poles 16 located at the corresponding corners 52 of a triangular sail 64. To the extent that the members shown in FIG. 2 correspond to those in FIG. 1, they are given like designations. Thus the poles 16 are driven vertically into the sand 12, the sail 54 being supported on the poles 16 by respective loops 46 connecting the corresponding corners 52. As shown in FIG. 3, the shank member 20 of the poles 16 can be made separable in an alternative configuration, the poles 16 having an upper shank member 56 and a lower shank member 58, the lower shank member 58 having at its upper end a coupling member 60, the coupling member preferably being permanently bonded to the lower shank member 58. The coupling member 60 has a socket member 61 for removably receiving a bottom end 62 of the upper shank member 56.

Although the present invention has been described in considerable detail with reference to certain preferred versions thereof, other versions are possible. For example, the cord 42 can be elastic for providing a flexible spring connection between the sail 14 and the shank member 20. Further, the loops 46 can incorporate springs. Thus the shank members 20 need not supply all of the flexibility that is needed for maintaining the tension and support of the sail 14. Therefore, the spirit and scope of the appended claims should not necessarily be limited to the description of the preferred versions contained herein.

What is claimed is:

1. An apparatus for shading a plot of sand comprising:

(a) a polygonal sheet member having at least three corners;

(b) a plurality of anchor poles corresponding to the corners of the sheet member, each pole comprising:

(i) a blade member for driving into the sand;

(ii) a shank member extending upwardly from the blade member;

(c) means for connecting the shank members of respective anchor poles to the corners of the sheet member, the connecting means comprising a loop member attached to the sheet member, the loop member enclosing a respective shank member; and (d) means for biasing the shank members outwardly against the connecting means, wherein, when the poles are driven into the sand in a pattern corresponding to the corners of the sheet member and displaced outwardly therefrom beyond the connecting means, the shank members can be connected to the connecting means, the shank members frictionally engaging the connecting means in response to tension in the sheet member so that the sheet member is supported by frictional engagement of the loop members with the poles at a desired location along substantially the full length of each of the shank members.

2. The apparatus of claim 1 wherein each pole has a root axis concentric with the shank member proximate the blade member, and the blade member comprises a plate member extending downwardly below the shank member parallel to the root axis, the plate member having a horizontal upper flange surface for receiving a downwardly directed force driving the blade member into the sand.

3. The apparatus of claim 2 wherein the plate member is triangular, having a lower apex substantially in line with the shank member.

4. The apparatus of claim 1 wherein the vertical length of the plate member below the upper flange surface is from about 1.5 to about 2.5 times the width of the plate member.

5. The apparatus of claim 2 wherein the plate member comprises a cylindrical segment portion and a pair of plane side portions extending tangentially on opposite sides thereof, forming a trough-shaped cross-section, the segment portion being concentric with the root axis of the pole, the opposite sides of the plate member forming a dihedral angle of from about 80° to about 160° along a line extending parallel to the root axis and outside the shank member, the root axis being located within the dihedral angle.

6. The apparatus of claim 5 wherein the dihedral angle is between 90° and about 115°.

7. The apparatus of claim 5 wherein the blade member is detachable from the shank member, the blade member including a socket member for lengthwise insertion of a lower end of the shank member, the segment member forming a downward extension of a portion of the socket member.

8. The apparatus of claim 1 wherein the blade member comprises a plastic material selected from a group consisting of styrene, nylon, ABS, polypropylene, and polyethylene.

9. The apparatus of claim 8 wherein the material of the blade member comprises polypropylene.

10. The apparatus of claim 1 wherein the shank member has an upper portion and a lower portion, the upper portion being detachable from the lower portion, the lower portion of the shank member including a socket member for lengthwise insertion of a lower end of the upper portion of the shank member.

11. The apparatus of claim 1 wherein the shank member comprises a tubular member.

12. The apparatus of claim 1 wherein the shank member comprises a plastic material.

13. The apparatus of claim 12 wherein the material of the shank member is selected from a group consisting of styrene, ABS, polypropylene, PVC, and polyethylene.

14. The apparatus of claim 13 wherein the material of the shank member comprises PVC.

15. The apparatus of claim 13 wherein the material of the shank member further comprises discrete particles for enhancing the stiffness of the shank member.

16. The apparatus of claim 15 wherein the material of the shank member comprises from about 70% to about 95% PVC, the discrete particles constituting approximately the remainder of the material.

17. The apparatus of claim 15 wherein the percentage of PVC is about 90%.

18. The apparatus of claim 12 wherein the biasing means includes the shank member being flexible, the biasing means exhibiting a lateral deflection of between about 4 inches to about 10 inches horizontally under a horizontal load of 4 pounds force applied 4 feet vertically above a rigidly fixed lower end of the shank member.

19. The apparatus of claim 1 further comprising a sideshade member and means for attaching the sideshade member to an outside edge of the sheet member, the sideshade member depending from the edge.

20. The apparatus of claim 19 wherein the means for attaching includes means for selectively positioning the sideshade member at a selected location along at least one of the edges.

21. The apparatus of claim 19 wherein the attaching means comprises a Velcro fastener connected between the sideshade member and the sheet member.

22. The apparatus of claim 1 wherein the connecting means comprises a plurality of cord members forming the loop members, the cord members being each fastened to the sheet member at a corner thereof, each loop member extending outwardly from the sheet member for receiving a respective one of the shank members.

23. The apparatus of claim 22 wherein at least some of the cord members include means for adjustably tensioning the loop members against the shank members after the poles are driven into the sand.

24. The apparatus of claim 5 wherein the plate member is triangular, having a lower apex substantially in line with the shank member.

25. The apparatus of claim 7 wherein the bottom of the socket member is vertically located proximate the top of the plate member.

26. An apparatus for shading a plot of sand comprising:

(a) a polygonal sheet member having at least three corners;

(b) a plurality of anchor poles corresponding to the corners of the sheet member, each pole comprising:

(i) a blade member for driving into the sand, each blade member comprising a triangular plate member extending downwardly below the shank member, parallel to a root axis of the pole, the plate member having a lower apex substantially in line with the root axis, and a substantially horizontal upper surface for receiving a downwardly directed force driving the blade member into the sand, the plate member having a trough-shaped cross-section;

(ii) a flexible tubular shank member extending upwardly from the blade member, the root axis being concentric with a portion of the shank member proximate the blade member, the shank member comprising a plastic material selected from a group consisting of styrene, ABS, polypropylene, PVC, and polyethylene, the shank member exhibiting a lateral deflection of between about 4 inches to about 10 inches horizontally under a horizontal load of 4 pounds force applied 4 feet vertically above a rigidly fixed lower end of the shank member;

(c) a plurality of cord members, the cord members being each fastened to the sheet member at corresponding corners thereof, each cord member forming a loop extending outwardly from the sheet member for receiving one of the shank members, wherein, when the anchor poles are driven into the sand in a pattern corresponding to the corners of the sheet member and displaced outwardly therefrom beyond the loops of the cord members, the shank members can be deflected inwardly toward the sheet member, protruding the loop members, the shank members biasingly tensioning the loops and the sheet member so that the sheet member is supported by frictional engagement of the loop members with the poles at a desired location along substantially the full length each of the shank members.

27. A method for shading a plot of sand comprising the steps of:

(a) providing a polygonal sheet member having at least three corners;

(b) providing a plurality of anchor poles corresponding to the corners of the sheet member, each pole comprising:

(i) a blade member for driving into the sand, each blade member comprising a triangular plate member extending on opposite sides of the shank member and downwardly in parallel relation to the shank member, the plate member having a lower apex substantially in line with the shank member and a substantially horizontal upper surface, the blade member having a trough-shaped cross-section along an axis paralleling the shank member;

(ii) a flexible cylindrically tubular shank member extending upwardly from the blade member, the shank member comprising a plastic material selected from a group consisting of styrene, ABS, polypropylene, PVC, and polyethylene, the shank member exhibiting a lateral deflection of between about 4 inches to about 10 inches horizontally under a horizontal load of 4 pounds force applied 4 feet vertically above a rigidly fixed lower end of the shank member;

(c) attaching a loop member to each corner of the sheet member for connecting to the shank member of the respective pole;

(d) driving the anchor poles into the sand in a pattern corresponding to the corners of the sheet member and displaced outwardly therefrom beyond the connecting means;

(e) deflecting the shank members inwardly toward the sheet member;

(f) sliding the loop members over the shank members; and (g) releasing the shank members for tensioning the sheet member by the loops so that sheet member is supported by frictional contact between the loops and the shank members at a desired location along substantially the full length of each of the shank members.

28. An apparatus for shading a plot of sand comprising:

(a) a polygonal sheet member having at least three corners;

(b) a plurality of anchor poles corresponding to the corners of the sheet member, each pole having a root axis and comprising:

(i) a blade member for driving into the sand parallel to the root axis, the plate member having a horizontal upper flange surface for receiving a downwardly directed force driving the blade member into the sand;

(ii) a shank member extending upwardly from the blade member, the root axis being concentric with the shank member proximate the blade member, the plate member extending downwardly below the shank member;

(c) means for connecting the shank members of respective anchor poles to the corners of the sheet member; and (d) means for biasing the shank members outwardly against the connecting means, wherein, when the poles are driven into the sand in a pattern corresponding to the corners of the sheet member and displaced outwardly therefrom beyond the connecting means, the shank members can be connected to the connecting means, the shank members frictionally engaging the connecting means in response to tension in the sheet member so that the sheet member is supported by the poles at a desired location along each of the shank members.

29. The apparatus of claim 28 wherein the plate member is triangular, having a lower apex substantially in line with the shank member.

30. The apparatus of claim 28 wherein the length of the plate member from the upper surface to the lower apex is from about 1.5 to about 2.5 times the width of the plate member.

31. The apparatus of claim 28 wherein the plate member comprises a cylindrical segment portion and a pair of plane side portions extending tangentially on opposite sides thereof, forming a trough-shaped cross-section, the segment portion being concentric with the root axis of the pole, the opposite sides of the plate member forming a dihedral angle of from about 80° to about 160° along a line extending parallel to the root axis and outside the shank member, the root axis being located within the dihedral angle.

32. The apparatus of claim 28 further comprising a sideshade member and means for attaching the sideshade member to an outside edge of the sheet member, the sideshade member depending from the edge.

33. The apparatus of claim 32 wherein the means for attaching includes means for selectively positioning the sideshade member at a selected location along one of the edges.

34. The apparatus of claim 32 wherein the attaching means comprises a velcro fastener connected between the sideshade member and the sheet member.

35. An apparatus for shading a plot of sand comprising:

(a) a polygonal sheet member having at least three corners;

(b) a plurality of anchor poles corresponding to the corners of the sheet member, each pole comprising:

(i) a blade member for driving into the sand, each blade member comprising a triangular plate member extending downwardly below the shank member, parallel to a root axis of the pole, the plate member having a lower apex substantially in line with the root axis and a substantially horizontal upper surface for receiving a downwardly directed force driving the blade member into the sand, the plate member having a cylindrical segment portion and a pair of plain side portions extending tangentially on opposite sides thereof, forming a trough-shaped cross-section, the segment portion being concentric with the root axis of the pole, the opposite sides of the plate member forming a dihedral angle of from about 80° to about 160° along a line extending parallel to the root axis;

(ii) a flexible tubular shank member extending upwardly from the blade member, the root axis being concentric with a portion of the shank member prximate the blade member, the shank member comprising a plastic material selected from a group consisting of styrene, ABS, polypropylene, PVC, and polyethylene, the shank member exhibiting a lateral deflection of between about 4 inches to about 10 inches horizontally under a horizontal load of 4 pounds force applied 4 feet vertically above a rigidly fixed lower end of the shank member;

(c) a plurality of loop members, the loop members being each fastened to the sheet member at corresponding corners thereof for receiving one of the shank members, wherein, when the anchor poles are driven into the sand in a pattern corresponding to the corners of the sheet member and displaced outwardly therefrom beyond the loop members, the shank members can be deflected inwardly toward the sheet member, protruding the loop members, the shank members biasingly tensioning the sheet member so that the sheet members is supported by frictional engagement of the loop members with the poles at a desired location along substantially the full length each of the shank members.

36. A method for shading a plot of sand comprising the steps of:

(a) providing a polygonal sheet member having at least three corners;

(b) providing a plurality of anchor poles corresponding to the corners of the sheet member, each pole comprising:

(i) a blade member for driving into the sand, each blade member comprising a triangular plate member extending downwardly below the shank member, parallel to a root axis of the pole, the plate member having a lower apex substantially in line with the root axis, and a substantially horizontal upper surface for receiving a downwardly directed force driving the blade member into the sand, the plate member having a trough-shaped cross-section including a cylindrical segment portion and a pair of plane side portions extending tangentially on opposite sides thereof, the segment portion being concentric with the root axis;

(ii) a flexible cylindrically tubular shank member extending upwardly from the blade member, the root axis being concentric with a portion of the shank member proximate the blade member, the shank member comprising a plastic material selected from a group consisting of styrene, ABS, polypropylene, PVC, and polyethylene, the shank member exhibiting a lateral deflection of between about 4 inches to about 10 inches horizontally under a horizontal load of 4 pounds force applied 4 feet vertically above a rigidly fixed lower end of the shank member, the bottom of the shank member being located proximate the horizontal upper surface of the of the blade member;

(c) attaching a loop member to each corner of the sheet member for connecting to the shank member of the respective pole;

(d) driving the anchor poles into the sand in a pattern corresponding to the corners of the sheet member and displaced outwardly therefrom beyond the connecting means;

(e) deflecting the shank members inwardly toward the sheet member;

(f) sliding the loop members over the shank members, the loop members enclosing the shank members; and (g) releasing the shank members for tensioning the sheet member by the loops so that sheet member is supported by frictional contact between the loops and the shank members at a desired location along substantially the full length of each of the shank members.

* * * * *